United States Patent [19]

Pointon

[11] 3,940,578

[45] Feb. 24, 1976

[54] KEYBOARD STRUCTURE HAVING PANEL MOUNTED KEY ACTUATORS WITH ELECTRICAL COMPONENT OPERATING ELEMENT

[75] Inventor: Peter Pointon, West Molesey, England

[73] Assignee: Alphameric Keyboards Limited, England

[22] Filed: Apr. 9, 1974

[21] Appl. No.: 459,901

[30] Foreign Application Priority Data

Apr. 9, 1973 United Kingdom ..... 16939/73

[52] U.S. Cl. ..... 200/5 A; 200/159 R; 200/295; 200/338; 200/340; 197/98; 235/145 R; 335/205; 340/365 R

[51] Int. Cl.[2]H01H 13/14; H01H 36/00; G06C 7/02

[58] Field of Search ..... 200/1 R, 5 R, 5 A, 159 R, 200/159 B, 293–296, 329–340; 178/17 C; 340/365 R, 363 E, 365 L; 235/145 R; 197/98–103; 335/205, 206

[56] References Cited

UNITED STATES PATENTS

| | | | |
|---|---|---|---|
| 3,404,315 | 10/1968 | Jacobs et al. | 200/294 X |
| 3,582,594 | 6/1971 | Twyford | 200/340 |
| 3,668,356 | 6/1972 | Kekas | 200/338 |
| 3,678,424 | 7/1972 | Iwashima et al. | 200/159 B X |
| 3,736,397 | 5/1973 | Pedersen | 200/340 X |
| 3,760,137 | 9/1973 | Shimojo et al. | 200/159 B X |
| 3,797,630 | 3/1974 | Zilkha | 197/98 |
| 3,829,632 | 8/1974 | Klehm, Jr. | 200/5 A |
| 3,829,646 | 8/1974 | Lorteije et al. | 200/5 A X |

OTHER PUBLICATIONS

IBM Technical Disclosure Bulletin, R. A. Johnson, "Keyboard," Vol. 13, No. 11, p. 3428, Apr. 1971.

IBM Technical Disclosure Bulletin, J. A. Mathewson et al., "Momentary Contact Actuator," Vol. 15, No. 10, pp. 3162–3163, Mar. 1973.

*Primary Examiner*—James R. Scott
*Attorney, Agent, or Firm*—Cushman, Darby & Cushman

[57] ABSTRACT

An electronic keyboard has a chassis with keys each utilising a parallel motion linkage to permit movement of an operating member towards an electric circuit element. The main structure of the keys and linkage may be formed as a unitary plastics moulding.

17 Claims, 24 Drawing Figures

Fig. 1.
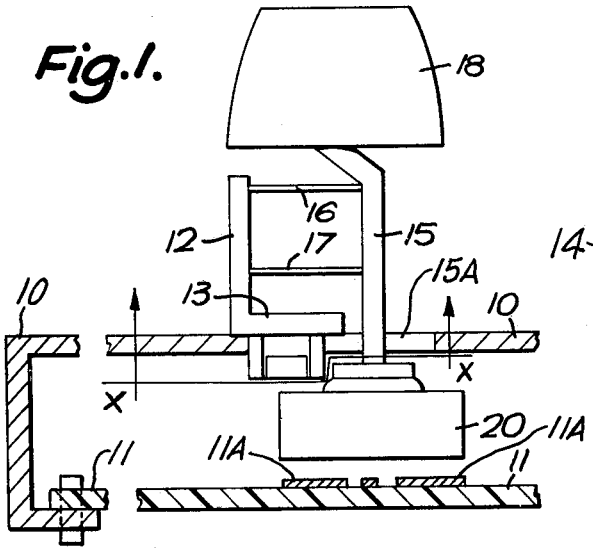
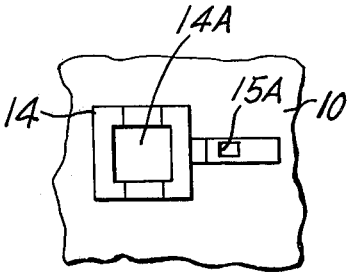
Fig. 1A
Fig. 2.
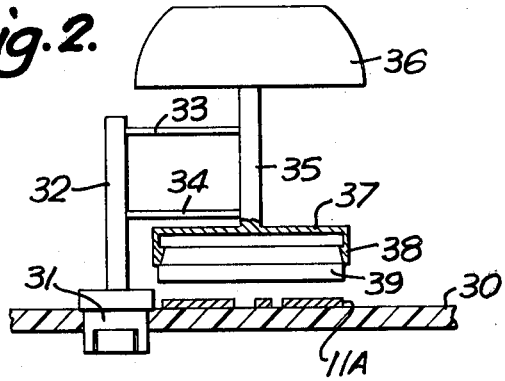
Fig. 5.
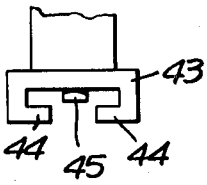
Fig. 6.
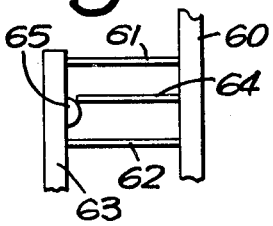
Fig. 7.
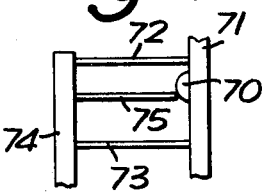
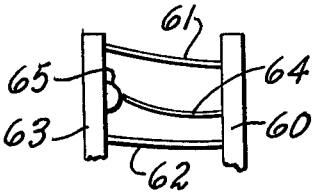
Fig 6A
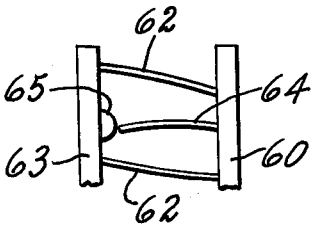
Fig. 6B Fig. 3.
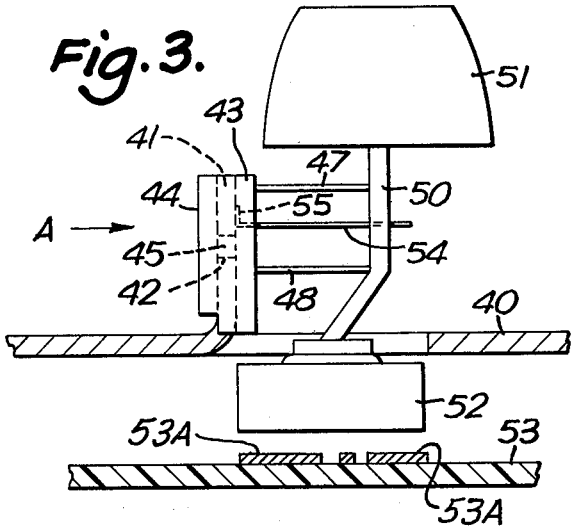
Fig. 4.
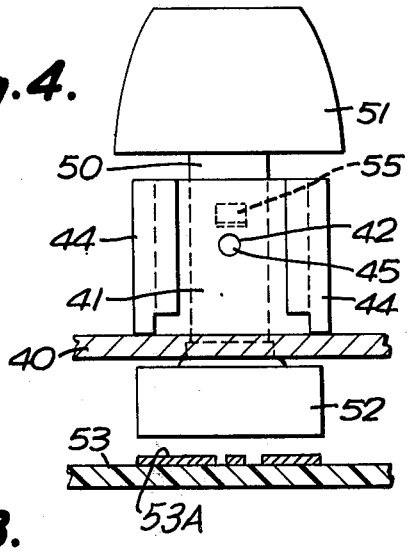
Fig. 4A
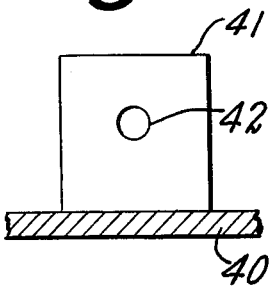
Fig. 8.
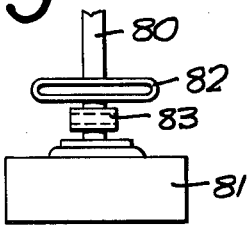
Fig. 9.
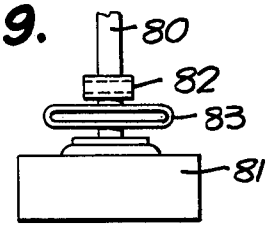
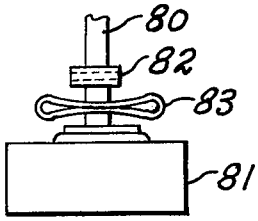
Fig. 9A

KEYBOARD STRUCTURE HAVING PANEL MOUNTED KEY ACTUATORS WITH ELECTRICAL COMPONENT OPERATING ELEMENT

BACKGROUND OF THE INVENTION

1. Field of Invention.

This invention relates to keyboards for providing an electrical output signal on depression of a key.

2. Prior Art.

Many forms of keyboard are used or have been proposed for providing electrical outputs corresponding to the keys which have been operated. The electrical signal output may be provided for example by direct mechanical operation of contacts in an electrical circuit or by changing the inductance or capacitance in an electrical circuit or by use of magnetically operated switches, e.g. reed switches or Hall effect devices. All such keyboards require a mechanically movable key member and it is the usual practice to make the key member slidable in a suitable guide. Resilient means have to be provided to return the key member after it has been depressed.

Various methods have been proposed in the past to simplify the key construction, in particular by combining the movement supporting structure with the resilient return means, for example, by forming a whole keyboard of resilient sheet material but such techniques have raised further problems.

SUMMARY OF THE INVENTION

It is an object of the present invention to provide an improved form of key board construction substantially simplifying the construction for supporting each movable key member.

According to this invention, a keyboard for providing an electrical output on depression of a key comprises a chassis and a plurality of keys, each key being formed of two substantially rigid members joined by at least a pair of parallel spaced resilient strips lying in separate planes, one of said rigid members being mounted on the chassis with the planes of the strip parallel to the chassis whereby the second of the rigid members is movable towards and away from the chassis without tilting with respect to the chassis, the second rigid member carrying an operating element arranged for co-operation with an electric circuit element on the chassis.

The operating element may be of any of a number of forms. For example, it may be a conductive element, e.g. of elastomeric material either made conductive or carrying a metal plate or metal/plastics laminate, arranged to co-operate with conductive elements on the chassis to provide an electrical coupling between the conductive elements or it may be a permanent magnet to co-operate with a reed switch or it may be a ferromagnetic slug to co-operate with an inductance on the chassis.

The rigid members conveniently are formed of a plastics material. The strips may be of metal which may be located in slots in the rigid members or the strips may be of plastics material. In the latter case, the two rigid members and the strips joining them may be formed as a single unitary structure, e.g. by moulding or machining.

A key top or cap member may be provided on the top of each of said second rigid members. Preferably such a key top resiliently grips an upstanding portion formed on or secured to the second rigid member.

It is possible to have more than two strips, e.g. three or more strips one above the other, or two or more pairs of strips which may be side by side.

The second rigid element may carry a key top. It is possible however to provide three or even more rigid elements, one being mounted on the chassis and connected by parallel resilient strips to a second rigid member which in turn is connected by parallel strips to a further rigid member carrying a key top.

The chassis conveniently is a metal or moulded plastics chassis and, for each key, the chassis may have a pair of upstanding lugs, e.g. upset portion of a sheet metal chassis, between which said first rigid member of the key is gripped. Preferably however a single lug is employed for each key, said one rigid member being formed with a slot or otherwise shaped to embrace or partially embrace the lug so that the member is positioned by the lug and held against lateral movement. Each upstanding lug may have a hole into which a projection in said one rigid member enters so that the member is secured after being positioned on a lug, the resilience of the lugs and/or rigid member permitting the projections to enter the holes.

Alternatively said one of the rigid members for each key may be located by means of a projection extending into an aperture in the chassis. Conveniently the projection fits tightly and is resiliently gripped in the aperture.

The aforementioned operating element may be carried below the chassis on a stem extending through an aperture in the chassis, and, in this case, may co-operate with a printed circuit board below the chassis. Alternatively the chassis may be constituted by a printed circuit board or by a support for a printed circuit board.

It will be seen that this method of construction permits of making a keyboard with relatively few components which are readily assembled. The keyboard can readily be made substantially noiseless in operation. It can have a low profile, that is to say the vertical height of the structure can be kept very small.

To permit overtravel, a spring or springs or other resilient element or elements may be incorporated below the second of said rigid members and the operating element. Such springs or resilient elements are preferably constructed to allow slight tilting of the operating element so that it aligns when it makes contact with the printed circuit board or other co-operating member.

It is sometimes required that the tactile characteristic or "feel" on operation of a key should be such that, after the key has been partially depressed against a gradually increasing resistance, this resistance should suddenly decrease and then increase gradually on further depression. To achieve this a further resilient strip may be formed on or secured to either one of said rigid members to co-operate with a projection on the other rigid member, this further strip gradually deflecting as its free end engages the projection until it has bent sufficiently to ride over and snap past the projection, the strip being subsequently restored to normal by the action of the parallel leaf spring.

BRIEF DESCRIPTION OF THE DRAWINGS

FIG. 1 is a diagrammatic side elevation illustrating one embodiment of a key mounted on a chassis;

FIG. 1A is an underside plan view of part of the construction of FIG. 1 taken along the line X—X;

FIG. 2 is a view similar to FIG. 1 of a second embodiment of the invention;

FIG. 3 is a view similar to FIGS. 1 and 2 of a third embodiment of the invention;

FIG. 4 is a view in the direction of the arrow A of the key of FIG. 3;

FIG. 4A is a view showing, in elevation, a lug of the construction of FIGS. 3 and 4;

FIG. 5 is a plan view of a member used in the key of FIGS. 3 and 4 for fitting over the lug shown in FIG. 4A;

FIG. 6 illustrates one construction for providing a required tactile characteristic for a key;

FIGS. 6A and 6B are diagrams illustrating the operation of the construction of FIG. 6;

FIG. 7 illustrates an alternative to the construction of FIG. 6 for providing a required tactile characteristic;

FIGS. 8 and 9 are respectively a side and end elevation of part of the movable element of a key showing the spring means for permitting overtravel;

FIG. 9A is a view similar to FIG. 9 but showing the springs deformed under overtravel conditions;

DESCRIPTION OF THE PREFERRED EMBODIMENT

Figure 17:
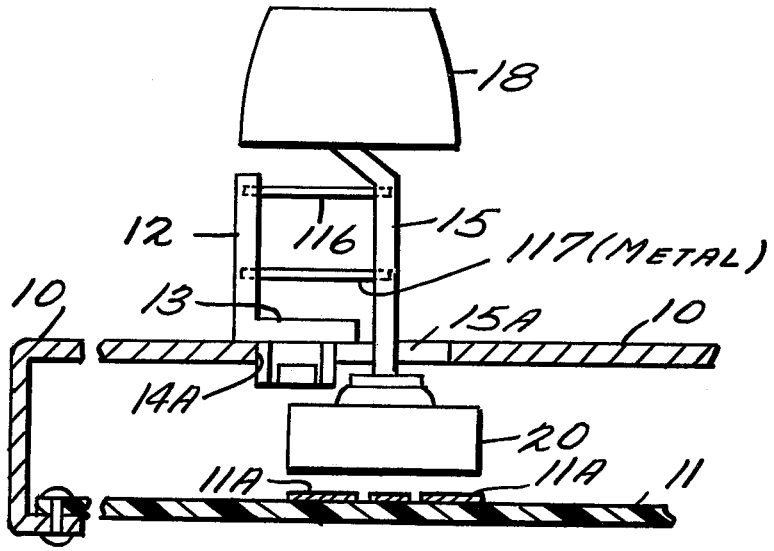
FIG. 17 shows a construction similar to FIG. 1 but in which the parallel motion linkage, instead of being formed integrally of plastics elements 12, 15, 16 and 17, is formed of two metal strips 116 and 117 which strips are located in slots in the plastics members 12, 15.
Figure 18:
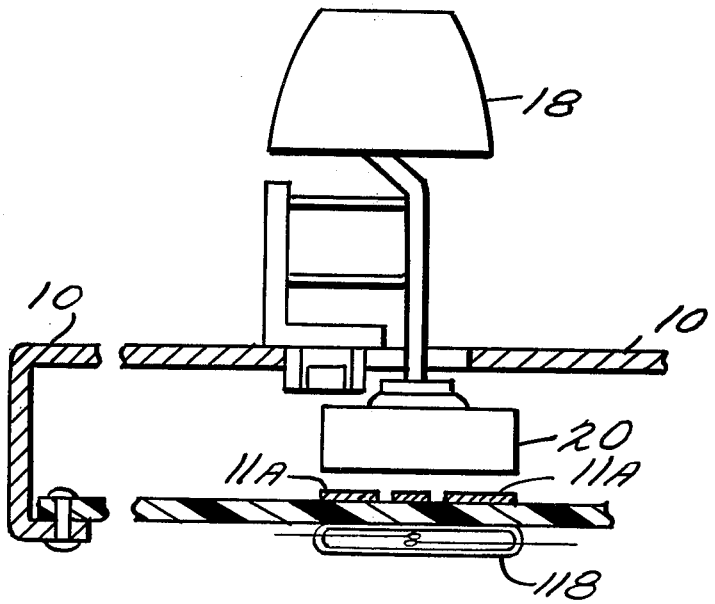
FIG. 18 illustrates the use of a reed switch operated by the key. The construction of FIG. 18 is similar to that of FIG. 1 except in so far as the member 20 is a permanent magnet; the magnet, when the key is depressed operates a reed switch 118.

Referring to FIGS. 1 and 1A there is shown diagrammatically a chassis 10 typically formed of sheet metal which chassis carries, a printed circuit board 11 below the chassis. For instance, the chassis may be bent down at each end as shown at 102 and is rivetted or otherwise secured to the printed circuit board. Obviously many constructions are possible for fixing the printed circuit board below the chassis. A key mounted on the chassis comprises a fixed substantially rigid plastics element 12, the base portion 13 of this member having a part 14 which extends downwardly secured as press fit into an aperture 14A (FIG. 1A) in the chassis, the part 14 being secured as press fit in the aperture 14A. The key has a second substantially rigid member 15 which, like the upright of the L-shaped member 12 is substantially in a flat plate in a vertical plane, the upright portion of the member 12 and the member 15 being joined by flat resilient strips 16, 17 spaced apart in vertical plane and parallel to one another. The strips 16, 17 are of equal length and, with the members 12, 15, form a parallel motion linkage. These strips 16, 17 may be metal spring strips secured in slots in the members 12, 15, as shown in FIG. 17 but preferably they are formed, as shown in FIG. 1 integrally with members 12, 15 and are thus of the same plastics material. The strips 16, 17 are made thin compared with the members 12, 15 so as to permit vertical deflection of the member 15 (with a slightly outward movement) relative to the member 12. The spring strips 16, 17 form a parallel motion linkage ensuring that the member 15 cannot tilt although it could be depressed downward against the resilient force provided by the members 16, 17. The member 15 carries on its upper end a key top 18 which, in the conventional way would have an alphanumeric character or other symbol on its top surface or be provided with a transparent cap through which such a symbol is visible. The key top 18 is shaped to be a press fit on the top end of member 15.

The member 15 extends downwardly through an aperture 15A in the chassis 10 and, below the chassis, carries a block 20 of elastomeric material which co-operates with the printed circuit board 11, which board has conductive elements, such as elements 11A, on its upper surface. This block 20 may be of conductive elastomeric material or may carry a metal plate or metal/plastics laminate to constitute an electrical conductor. The block 20 may for example bridge two conductive areas on the printed circuit board to form a conductive, possibly resistive path between these two areas or to provide capacitive couplings between these two conductive areas on the printed circuit board.

FIG. 2 illustrates a modification of the construction of FIG. 1 in which a printed circuit board 30 constitutes the chassis, the key being mounted on this printed circuit board by means of a portion 31 which is a press fit with an aperture in the chassis. Above the portion 31 there is a substantially rigid plate 32 connected by parellel strip portions 33, 34 to a second rigid plate 35 to form a parallel motion linkage similar to that of FIG. 1. The member 35 carries a key top 36 on its upper end and, at its lower end has an inverted cup shape element 37 with a shaped projection 38 extending around the periphery of the inner surface of the cup to grip a conductive elastomeric element 39. This co-operates with conductive areas on the printed circuit board 30 in a manner similar to the previously described embodiment.

FIGS. 3, 4, 4A and 5 illustrate another embodiment of the invention in which a metal chassis 40 has an upstanding lug portion 41 with an aperture 42. The lug is illustrated in FIG. 4A which is a view of the lug, with the key removed, looking in the direction of the arrow A in FIG. 3. The fixed element 43 of the parallel motion linkage is shaped as shown in FIG. 5 to have arms 44 (see FIG. 5) which partically embrace the upstanding lug. A projecting portion 45 on the member 43 fits into the aperture 42 when the member 43 is forced down over the lug 41. The member 43 preferably has a wedge shaped outer surface so that, by reason of the slight resilience of the plastics material, the member 43 can be forced downwardly until the projection snaps into the hole whereupon the member 43 is secured in positon. As in the previously described construction there are parallel strips 47, 48 of resilient material, conveniently moulded integrally with the plastics material 43 to form a parallel motion linkage supporting a plate 50 which carries the key top 51. The plate at its lower end carries a block 52 of conductive elastomeric material which co-operates with conductive elements 53A on a printed circuit board 53. In the embodiment illustrated, there is shown an additional spring strip 54 which passes through slots in the members 43 and 50, one end of the strip 54 having an upstanding portion 55 which fits within a recess in the member 43 so as to be held in position by the lug 41 when the member 43 is positioned over the lug. Such a metal spring strip 54 can be inserted in the key before assembly to provide increased resistance to motion. This arrangement thus provides a simple means of adjusting the key construction to provide any required spring rate for the depression motion of the key.

For some purposes, in a keyboard, it is required to have a tactile characteristic or feel such that, as the key is depressed, the resistive force gradually increases and then suddenly decreases before further gradually increasing. This may be achieved in a number of ways. FIG. 6 illustrates one construction in which the movable element 60 of the parallel motion linkage is connected by strips 61, 62 fixed element 63. To provide the required characteristic, a further resilient strip 64 is mounted on or formed integrally with the movable element 60 and co-operates with a rounded projection 65 on the fixed element 63. As the key is depressed, the free end of the element 64 gradually rides over the rounded projection 65, the strip 64 bending (as shown in FIG. 6A) and thus giving gradually increased resistance to the motion of the key until the bending is sufficient as shown in FIG. 6B for the free end to ride completely over the element 65. This gives the sudden reduction in the resistive force. Further depression of the key is then against the resistive force provided by the resilience of the strip 61, 62.

FIG. 7 illustrates a modification of the construction of FIG. 6 in which there is a rounded projection 70 on the movable element 71. This movable element is connected by the spring strips 72, 73 to the fixed member 74. The additional spring strip 75 is secured on the member 74. In this construction the projection 70 moves past the free end of the strip 75 to give an operation similar to that of the FIG. 6 construction.

After the elastomeric element has come in contact with the printed circuit board or other co-operating structure, certain limited amount of overtravel is possible by reason of the resilience of this element. However it may be required to have more overtravel than is possible in this way. FIGS. 8, 9 and 9A illustrate one construction for permitting overtravel. Referring to these FIGS. there is shown a plunger stem 80 which is carried on the movable element of the key and which at its lower end carries the elastomeric element 81. In the construction of FIGS. 8 and 9, two resilient loop springs 82, 83 are provided between the stem 80 and the elastomeric element 81. Each of these elements is in the form of a flat loop of strip metal or plastics material. The axes of the two loops are at right angles. The overtravel is permitted by deformation of each of these two loops which can compress to bring, in each loop, the two flattened portions of the loop closer together as shown in FIG. 9A. The flattened resilient loops each permit a limited amount of tilting of the elastomeric element 81 with respect to the stem 80. By providing the two loops with their axes orthogonal, tilting about any axis parallel to the plane of the printed circuit board is possible. This tilting results in the element 81 being self-aligning so that its lower surface engages the printed circuit board and lies parallel thereto despite any misalignment of the key or board.

Figure 10:
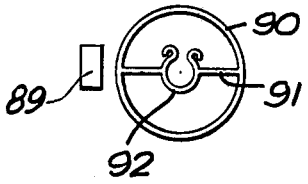
FIGS. 10, 10A and 11 illustrate a mechanical switch for operation by a key of the present invention.
Figure 11:
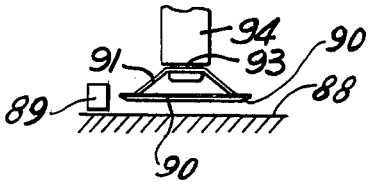
Figure 10A:
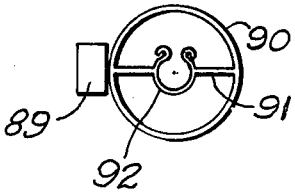

As previously indicated, many forms of circuit operating element may be employed which cause a modification of circuit conditions when a key is depressed. FIGS. 10A and 11 illustrate a mechanical switch suitable for operation by the mechanisms previously described. In FIGS. 10 and 11, there is shown a metal ring 90 having two inwardly extending radial arsm 91 carried on a part circular resilient element 92 which resiliently grips in a recess 93 extending around a stem 94 of the movable element of the key. It will be seen that, as the key is depressed, when the ring 90 comes into contact with a fixed abutment 18, the arms 91 will gradually be deflected outwardly. This outward deflection of the ring at opposite ends of a diameter deforms the ring 90 as shown in FIG. 10A and brings a part of the ring into contact with a fixed element 89 to effect completion of a circuit. The outer ring 90 may be divided to provide a snap action.

Figure 12:
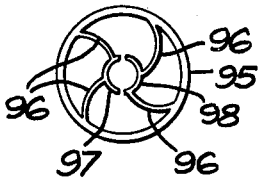
FIGS. 12 and 13 illustrate a second form of mechanical switch for a key of the present invention.
Figure 13:
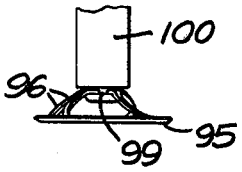

FIGS. 12 and 13 illustrate a modification of the switch of FIGS. 10 and 11 in which a metal ring 90 is carried on four arms 96 which in this construction are non-radial. One pair of these arms carries a part circular element 97 and the other pair of arms 96 carries a second part circular element 98, these two part circular elements fitting in a groove 99 in the stem 100 of the movable element of the key. It will be seen that the switch of FIGS. 12 and 13 operates in a similar manner to that of FIGS. 10 and 11.

Figure 14:
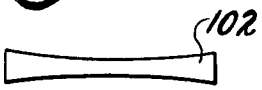
FIGS. 14 and 15 are a side elevation and a plan view of one form of strip used in the embodiments of FIGS. 1, 2 and 3.
Figure 15:
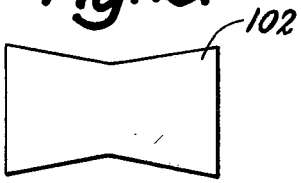
Figure 16:
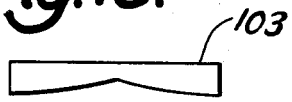
FIG. 16 is a side elevation of another form of strip.

In constructions using parallel strips of plastics material, to increase the operational life, it is preferred to use polyamide material which is shaped to suitably align the crystal structure and to make the stresses uniform. FIGS. 14 and 15 are respectively a side elevation and a plan view of one form of strip 102 formed by coining (i.e. pressing as in a coin press) after moulding. It will be noted that the strip is narrower in width at its centre and also thinner. FIG. 16 is a side elevation of another form of strip 103 which is rectangular in plan.

I claim:

1. A keyboard for providing an electrical output on depression of a key, said keyboard comprising a chassis and a plurality of keys, wherein each key is formed of two substantially rigid members spaced apart with facing surfaces and at least a pair of parallel spaced resilient strips lying in separate planes spaced in a direction normal to said surfaces, said strips being of equal length, each extending between said rigid members and joining said rigid members to form a parallel motion linkage, one of said rigid members being mounted on the chassis with the planes of the strip parallel to the chassis, a key top mounted on the upper end of the second of said rigid members whereby, by depression of the key top, the second of the rigid members is movable towards and away from the chassis without tilting with respect to the chassis, and an operating element on the lower end of the second rigid member arranged for co-operation with an electric circuit element fixedly located with respect to the chassis.

2. A keyboard as claimed in claim 1 wherein said operating element is a permanent magnet arranged to co-operate with a reed switch.

3. A keyboard as claimed in claim 1 wherein said rigid members are formed of a plastic material.

4. A keyboard as claimed in claim 3 wherein said strips are formed of metal located in slots in the rigid members.

5. A keyboard as claimed in claim 3 wherein the strips are formed of plastics material.

6. A keyboard as claimed in claim 5 wherein the two rigid members and the strips joining them are formed as a single unitary structure.

7. A keyboard as claimed in claim 1 wherein said second rigid member has an upstanding portion and wherein said key top resiliently grips said upstanding portion.

8. A keyboard as claimed in claim 1 wherein, for each key, a single lug is provided on said chassis, and wherein said one rigid member is shaped to at least partially embrace the lug so that the member is positioned by the lug and held against lateral movement.

9. A keyboard as claimed in claim 1 wherein, for holding each key, at least one upstanding lug is provided on said chassis and wherein said one rigid member on each key has a lateral projection and wherein each upstanding lug has a hole into which said projection eneters so that the member is secured after being positioned on a lug.

10. A keyboard as claimed in claim 1 wherein, on each key, said one of the rigid members is provided with a locating projection adapted to extend into a locating aperture in the chassis.

11. A keyboard as claimed in claim 10 wherein the projection fits tightly and is resiliently gripped in the aperture.

12. A keyboard as claimed in claim 1 wherein said second rigid member includes a stem extending through an aperture in said chassis and wherein said operating element is carried below the chassis on said stem.

13. A keyboard as claimed in claim 1 wherein the chassis is constituted by a printed circuit board.

14. A keyboard as claimed in claim 1 and having a printed circuit board below said chassis to form said electric circuit element.

15. A keyboard as claimed in claim 1 wherein at least one resilient element is provided on the second of said rigid members and wherein said operating element is mounted on said one resilient element to permit overtravel.

16. A keyboard as claimed in claim 1 wherein a further resilient strip is carried by one of said rigid members, said further resilient strip, in its unstressed condition, extending parallel to the aforesaid strips and wherein the other rigid member has a projection to engage said resilient strip on depression of the key top, said further strip being dimensioned and arranged so that it gradually deflects as its free end engages the projection until it has bent sufficiently to ride over and snap past the projection.

17. A keyboard as claimed in claim 1 wherein a printed circuit board with conductive elements comprises said circuit element, said chassis carrying said printed circuit board, wherein said operating element is a further conductive element arranged to co-operate with said firstmentioned conductive elements on the printed circuit board to provide electrical coupling between the conductive elements.

* * * * *